US011415074B1

(12) United States Patent
Fluharty et al.

(10) Patent No.: US 11,415,074 B1
(45) Date of Patent: Aug. 16, 2022

(54) ENGINE CYLINDER HEAD WITH INTEGRATED EXHAUST MANIFOLD AND TEMPERATURE SENSOR

(71) Applicant: FORD GLOBAL TECHNOLOGIES, LLC, Dearborn, MI (US)

(72) Inventors: Jeffrey D. Fluharty, Woodhaven, MI (US); Forest Heggie, LaSalle (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/188,533

(22) Filed: Mar. 1, 2021

(51) Int. Cl.
*F02F 1/24* (2006.01)
*F01N 13/10* (2010.01)
*F01P 11/16* (2006.01)

(52) U.S. Cl.
CPC ..... *F02F 1/243* (2013.01); *F01N 13/105* (2013.01); *F01P 11/16* (2013.01); *F01P 2025/33* (2013.01)

(58) Field of Classification Search
CPC .... F02F 1/243; F01N 13/105; F01N 2560/06; F01P 11/16; F01P 2025/33; F02B 77/086
See application file for complete search history.

(56) References Cited

U.S. PATENT DOCUMENTS

| | | | | |
|---|---|---|---|---|
| 5,669,337 | A | 9/1997 | Drouillard | |
| 6,026,679 | A | 2/2000 | Holmes et al. | |
| 9,127,586 | B2 * | 9/2015 | Adachi | G01K 13/02 |
| 2011/0132296 | A1 | 6/2011 | Kuhlbach | |
| 2012/0245830 | A1 | 9/2012 | Eser et al. | |
| 2018/0142629 | A1 * | 5/2018 | Stockner | F02D 35/023 |
| 2018/0171914 | A1 * | 6/2018 | Ulrey | F02N 19/004 |

* cited by examiner

*Primary Examiner* — Grant Moubry
(74) *Attorney, Agent, or Firm* — Vincent Mastrogiacomo; Brooks Kushman P.C.

(57) ABSTRACT

An engine includes a block defining at least one cylinder and a cylinder head received on the block. The cylinder includes a casting defining an exhaust port in fluid communication with the cylinder and an integrated exhaust manifold. The integrated exhaust manifold has an exhaust runner defined by the casting and extending from the exhaust port to an outlet defined on an outer surface of the casting. The casting includes a protrusion extending into the exhaust runner such that a raised dimple is disposed on a sidewall of the exhaust runner. The casting further defines a sensor bore extending towards the protrusion such that the sensor bore and the protrusion have a common centerline. A temperature sensor is disposed in the sensor bore and has a sensing element arranged in proximity to the protrusion such that the sensing element reads a temperature of the protrusion.

20 Claims, 4 Drawing Sheets

ENGINE CYLINDER HEAD WITH INTEGRATED EXHAUST MANIFOLD AND TEMPERATURE SENSOR

TECHNICAL FIELD

This disclosure relates to engine cylinder heads having integrated exhaust manifolds and more particularly to measuring temperatures of cylinder heads using a sensor.

BACKGROUND

An internal combustion engine includes reciprocating pistons disposed within cylinders of an engine block. The pistons are connected to a crankshaft that outputs power produced by the pistons. One or more cylinder heads are disposed on the block. Each cylinder head defines intake and exhaust ports that are in fluid communication with the cylinders and includes intake and exhaust valves that selectively open and close the ports. One or more camshafts control operation of the valves. Traditionally, an exhaust manifold is attached to the cylinder head.

SUMMARY

According to one embodiment, an engine includes a block defining at least one cylinder and a cylinder head received on the block. The cylinder includes a casting defining an exhaust port in fluid communication with the cylinder and an integrated exhaust manifold. The integrated exhaust manifold has an exhaust runner defined by the casting and extending from the exhaust port to an outlet defined on an outer surface of the casting. The casting includes a protrusion extending into the exhaust runner such that a raised dimple is disposed on a sidewall of the exhaust runner. The casting further defines a sensor bore extending towards the protrusion such that the sensor bore and the protrusion have a common centerline. A temperature sensor is disposed in the sensor bore and has a sensing element arranged in proximity to the protrusion such that the sensing element reads a temperature of the protrusion.

According to another embodiment, a cylinder head includes a casting defining a plurality of exhaust runners that collectively form an integrated exhaust manifold disposed within the cylinder head. The casting protrudes into one of the exhaust runners to form a dimple raised from a sidewall of the one of the exhaust runners. A sensor bore is defined by the casting and extends towards the dimple such that a bottom of the sensor bore is adjacent to the dimple.

According to yet another embodiment, a cylinder head includes a casting defining a plurality of exhaust runners that collectively form an integrated exhaust manifold disposed within the cylinder head. One of the exhaust runners includes a raised dimple that forms an artificial hot spot of the casting. During operation, a temperature of the raised dimple is substantially equal to a temperature of a natural hot spot of the cylinder head. A sensor bore is defined by the casting and extends towards the dimple such that a bottom of the sensor bore is adjacent to the dimple.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
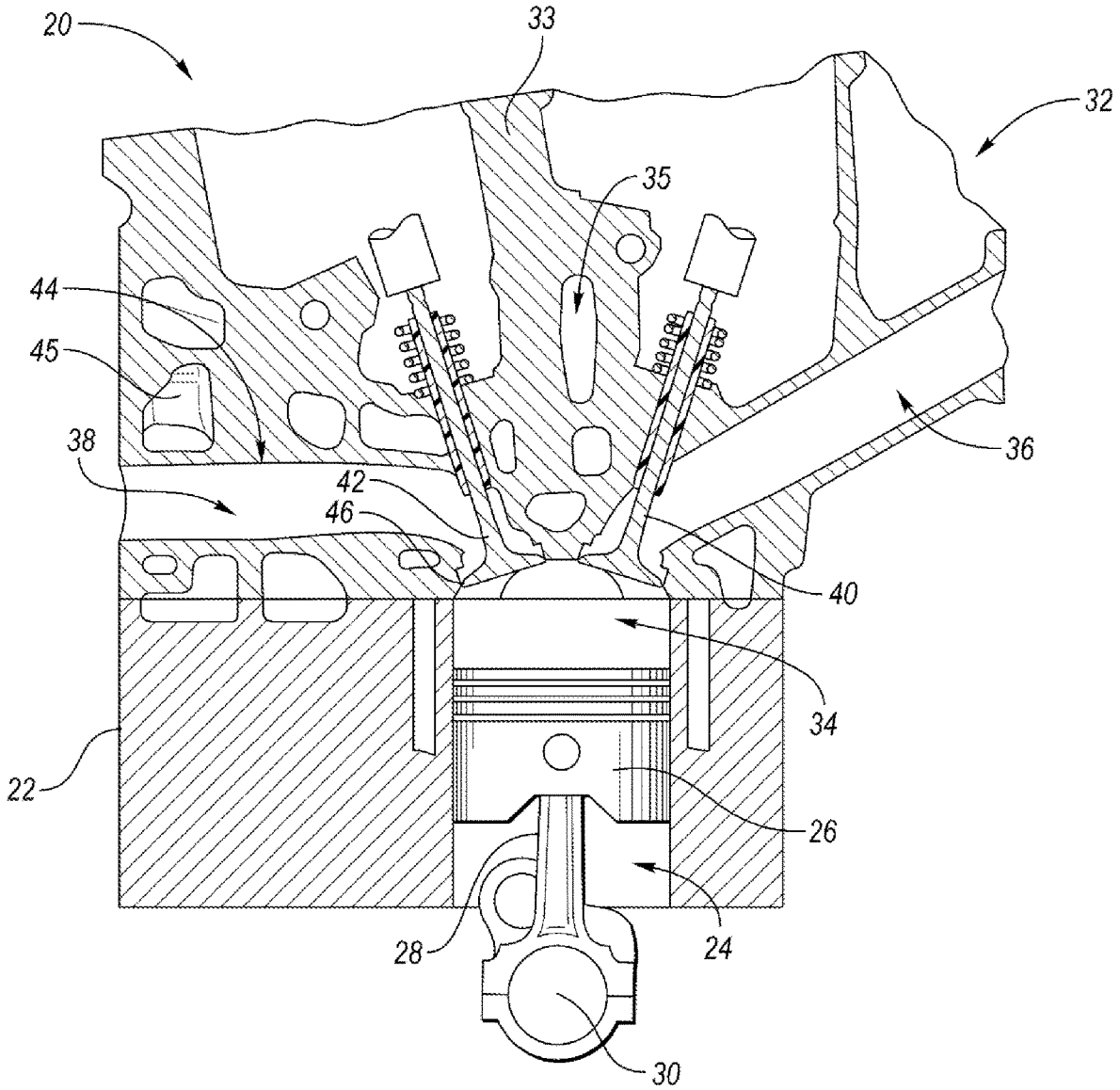
FIG. 1 is a cross-sectional view of an engine.

Referring to FIG. 1, an engine 20 includes a block 22 defining a plurality of cylinders 24. The illustrated block 22 is of an inline four-cylinder engine, however, this disclosure contemplates many engine configurations such as an inline six, a V6, a V8, or any other known configuration. Pistons 26 are supported in the cylinders 24. Each of the pistons 26 includes a rod 28 that connects with the crankshaft 30. A cylinder head 32 is connected on top of the block 22. The cylinder head 32 includes a metal casting 33 such as aluminum alloy, cast iron, or the like. A head gasket (not shown) is typically placed between the cylinder head 32 and the block 22. The cylinder head 32 cooperates with the block 22 to form combustion chambers 34. The combustion chambers 34 receive intake air from the intake manifold via intake passages or runners 36. Similarly, exhaust combustion gases exit the combustion chamber 34 via exhaust passages or runners 38. Each of the combustion chambers 34 may include at least one intake runner 36 and at least one exhaust runner 38. Intake valves 40 and exhaust valves 42 selectively connect the combustion chamber 34 in fluid communication with the intake and exhaust runners 36, 42. The intake and exhaust valves 40, 42 are opened and closed by one or more camshafts (not shown). In the illustrated embodiment, the engine 20 has dual-overhead camshafts with four valves per cylinder, e.g., two intake valves and two exhaust valves, two exhaust runners, and two intake runners.

The casting 33 also defines a water jacket 35 having a plurality of coolant passageways 45 configured to circulate a liquid coolant, e.g., antifreeze, though the head and block and provide cooling. The coolant passageways 45 are connected to a coolant system having at least a water pump and a heat exchanger, e.g., a radiator, as known in the art.

The intake runners 36 defined in the cylinder head 32 connect with an intake manifold (not shown). The intake manifold receives air from a throttle body that may include a valve for controlling operation of the engine. The throttle body either receives air at atmospheric pressure from an air box or receives compressed air in the case of a turbocharged or supercharged engine. The illustrated engine 20 may include a turbocharger (not shown) having a turbine that is powered by exhaust gases.

Figure 2:
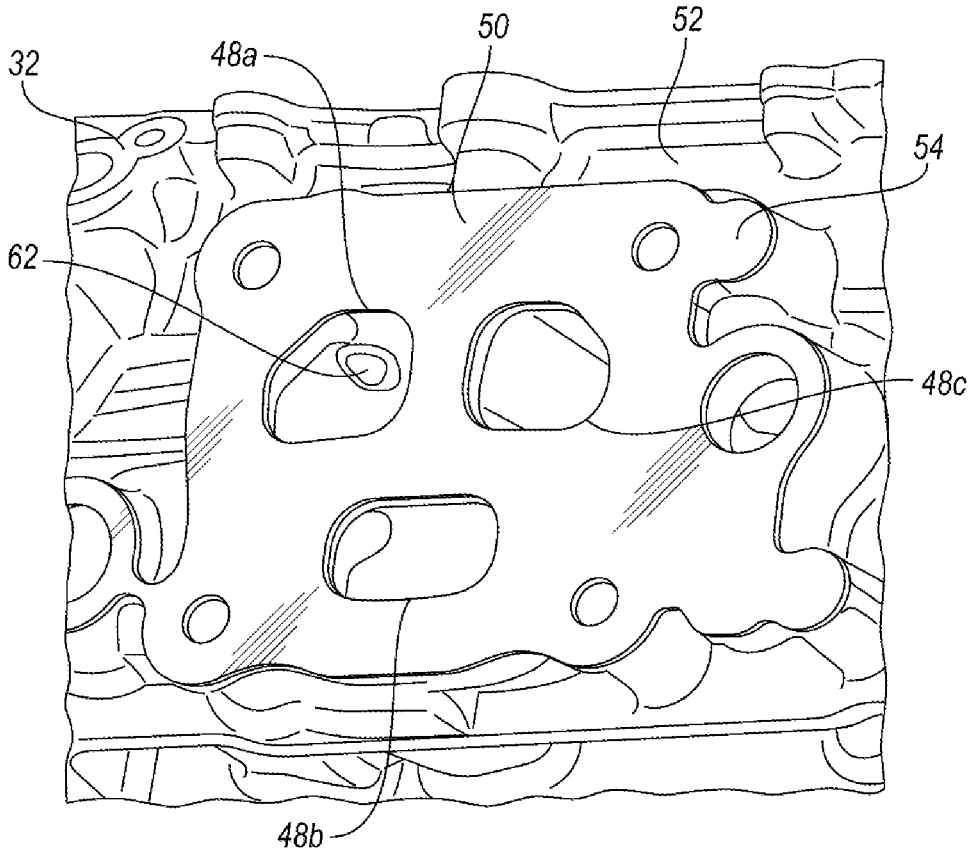
FIG. 2 is a perspective view of a cylinder head of the engine.
Figure 3:
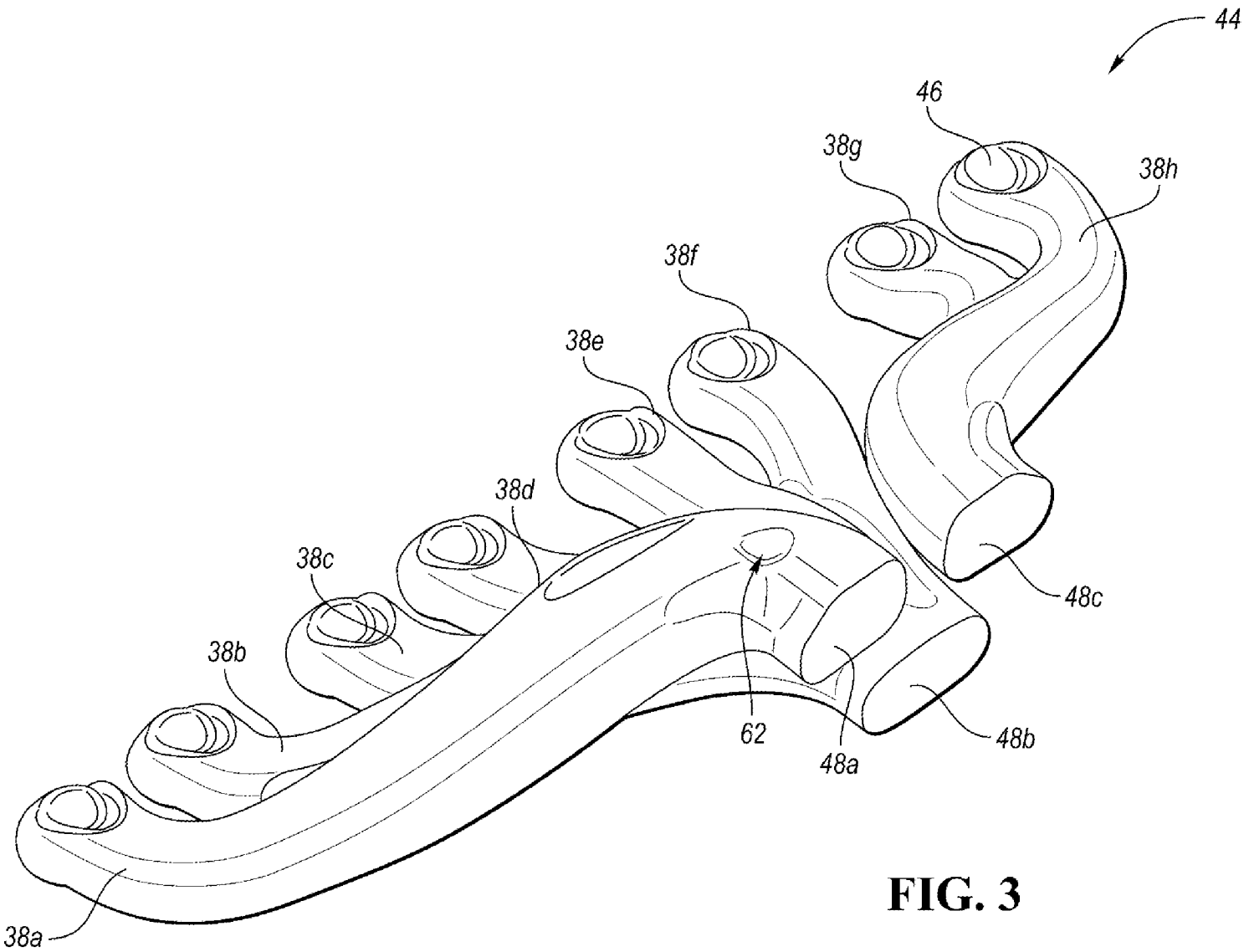
FIG. 3 is a negative perspective view of the integrated exhaust manifold showing the void space as a solid.

Referring to FIGS. 1, 2, and 3, the engine 20 includes an integrated exhaust manifold 44 including the exhaust runners 38. That is, the runners 38 of the integrated exhaust manifold 44 may be completely contained within the cylinder head 32 and defined by the casting 33, as opposed to traditional designs, in which the exhaust manifold is a separate component attached on the outside of the cylinder head. Here, the casting 33 of the cylinder head 32 defines the exhaust runners 38. Advantages of integrated exhaust manifolds include packaging size, liquid-cooling of the exhaust gases, improved fuel economy, and reduced emissions. Each of the exhaust runners 38 extends from an exhaust port 46 to an exhaust outlet 48.

The exhaust outlets 48 may be formed on an exhaust boss 50 disposed on a side 52 of the cylinder head 32. In the illustrated embodiment, the exhaust boss 50 defines three exhaust outlets 48. Of course, the number of exhaust outlets 48 may be increased or decreased in other embodiments depending upon the number of cylinders of the engine, the flow requirements of the exhaust runners, and the like. Each of the exhaust runners 38 are defined by the casting and extend from the corresponding exhaust port to the corresponding outlet 48 defined on an outer surface of the casting. The exhaust runners 38 each begin as a dedicated runner for an associated exhaust port and later converge with other runners as they extend to the exhaust outlets 48. For example, runners 38*a* and 38*b* of cylinder 1 converge and exit through exhaust outlet 48*a*, runners 38*c* and 38*d* of cylinder 2 converge with runners 38*e* and 38*f* of cylinder 3 and exit through exhaust outlet 48*b*, and runners 38*g* and 38*h* of cylinder 4 converge and exit through exhaust outlet 48*c*. The exhaust boss 50 defines a seating surface 54 configured to mate with an associated exhaust component such as a turbocharger, an exhaust pipe, etc. For example, the engine 20 is turbocharged and a turbocharger (not shown) mounts to the exhaust boss 50.

Figure 4:
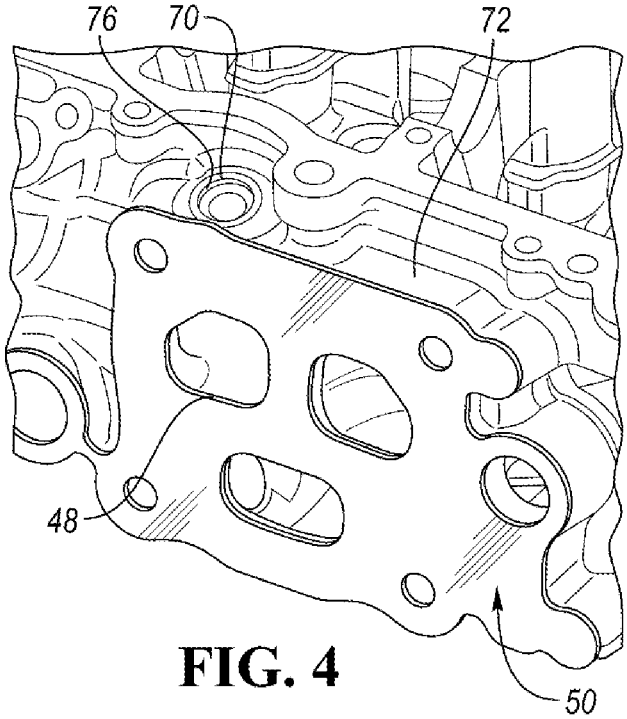
FIG. 4 is another perspective view of the cylinder head.
Figure 5:
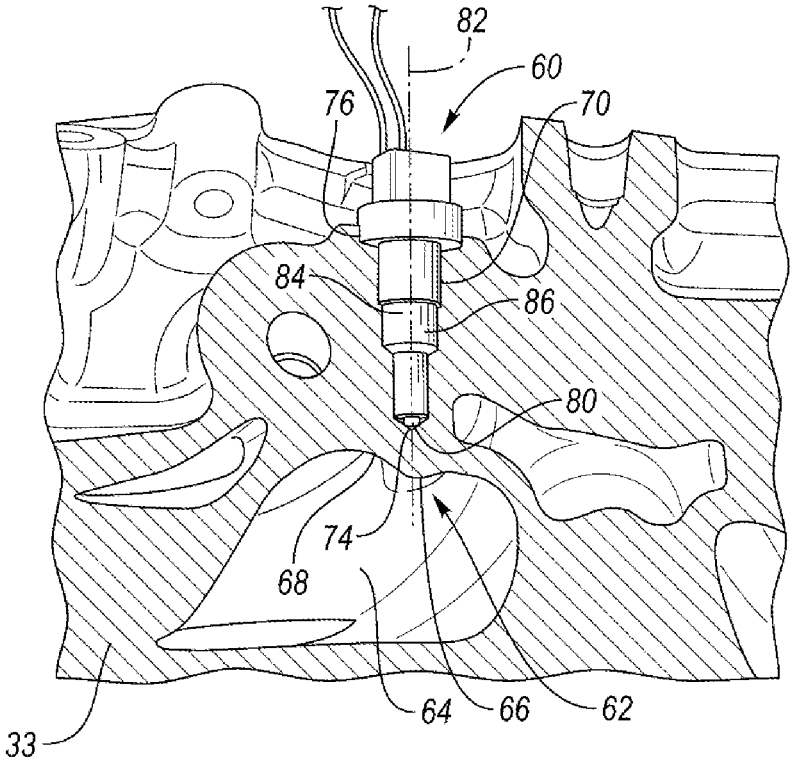
FIG. 5 is a cross-sectional view of the cylinder head showing a temperature sensor and associated dimple.

Referring to FIGS. 2, 4, and 5, the engine 20 may include a cylinder-head temperature sensor 60 configured to sense a temperature of the casting 33. The sensor 60 is in electric communication with a controller and outputs a signal indicative of a sensed temperature of the cylinder head 32. The engine 20 may also be equipped with an optional engine coolant temperature sensor configured to sense a temperature of the liquid coolant. The sensor 60 may be used, among other things, to determine an over-heating condition of the cylinder head 32. The temperature of the casting 33 of the cylinder head 32 is not homogeneous and the casting 33 may have hot spots due to the geometry of the integrated exhaust system in conjunction with the geometry of the water jacket and the casting. In order to more accurately determine an over-heating condition, the sensor 60 may be placed in a location that tends to be the hottest during extreme conditions.

The natural hot spot(s) of the casting 33 may occur in an area that will not accommodate a temperature sensor. (The temperature sensor 60 must be located in an area with external access for wiring and serviceability.) To solve this and other problems, the casting 33 may be designed with an artificial hot spot in an area that can receive a temperature sensor. The artificial hot spot is an added feature configured to heat in a way that mimics the natural hot spot. The addition of the artificial hot spot allows for accurate temperature readings of the cylinder head while avoiding packaging constraints.

The artificial hot spot can be created by adding a raised dimple 62 on the sidewall 64 of one of the runners 38. The raised dimple 62 is a projection 66 of the casting 33 into the exhaust gas flow path. The dimple 62 is disposed in the exhaust gas flow path of the exhaust runner 38 and thus comes into direct contact with the hot exhaust gases. This causes the dimple 62 to become hot thus creating an artificial hot spot. The size, shape, and location of the dimple 62 can be tuned to act like the natural hot spot of the cylinder head 32. That is, the dimple 62 is designed so that the temperature of the dimple is substantially equal to the temperature of the natural hot spot. In this context, substantially equal in temperature means within plus or minus ten percent. In the illustrated embodiment, the dimple 62 is disposed on the ceiling 68 of the exhaust runner 38 near the exhaust outlet 48*a* and within or near the exhaust boss 50 to facilitate packaging of the sensor 60.

The temperature sensor 60 is receivable in a sensor bore 70 defined by the casting 33. The sensor bore 70 may be formed by a drilling operation or the like. In the illustrated embodiment, the bore 70 extends through the exhaust boss 50. The bore 70 may extend downwardly from an upper sidewall 72 of the exhaust boss 50. The exhaust boss 50 may be a cylindrical hole having a plurality of different diameters, which may become progressively smaller into the casting 33. For example, a bottom 74 of the bore 70 may have a smaller diameter than an opening 76 of the bore. The bore 70 extends towards the dimple 62 such that the bottom 74 of the bore is in close proximity to the dimple 62. The bottom 74 may or may not extend into the dimple 62.

The dimple 62 may have a generally conical shape. The dimple 62 may only be a portion of the cone due to the oblique angle of the dimple 62 relative to the sidewall 64 of the exhaust runner 38. The dimple 62 and the bore 70 may be axially aligned and share a common centerline 82. The intersection of the dimple 62 and the sidewall 64 may be fileted to provide a smoother transition.

The sensor 60 includes a body 84 disposed in the bore 70. A portion of the body may include threads to connect with threads on the bore 70. Alternative attachment means include clips, snaps, interference fit, adhesive, or the like. The body 84 includes a tip 80 disposed against the bottom 74 of the bore 70. The tip 80 includes a temperature-sensing element 86, such as a thermistor, thermocouple, or the like configured to measure the temperature of the surrounding casting 33.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An engine comprising:

a block defining at least one cylinder;

a cylinder head received on the block and including a casting defining an exhaust port in fluid communication with the cylinder and an integrated exhaust manifold, the integrated exhaust manifold having an exhaust runner defined by the casting and extending from the exhaust port to an outlet defined on an outer surface of the casting, wherein the casting includes a protrusion extending into the exhaust runner such that a raised dimple is disposed on a sidewall of the exhaust runner, and wherein the casting further defines a sensor bore extending towards the protrusion such that the sensor bore and the protrusion have a common centerline; and a temperature sensor disposed in the sensor bore and having a sensing element arranged in proximity to the protrusion such that the sensing element reads a temperature of the protrusion.

2. The engine of claim 1, wherein the dimple is located on a ceiling of the exhaust runner.

3. The engine of claim 1, wherein the dimple is located nearer to the outlet than the exhaust port.

4. The engine of claim 1, wherein the cylinder head further includes an exhaust boss disposed on a side of the cylinder head, and wherein an opening of the sensor bore is disposed on the exhaust boss.

5. The engine of claim 1, wherein the sensor bore includes a first section having a first diameter and a second section having a second diameter that is smaller than the first diameter.

6. The engine of claim 1, wherein the dimple has a conical shape.

7. The engine of claim 1, wherein the casting further defines at least one coolant passage configured to cool the integrated exhaust manifold.

8. The engine of claim 1, wherein the block defines additional cylinders, and the integrated exhaust manifold further has additional exhaust runners defined in the casting and associated with the additional cylinders.

9. The engine of claim 1, wherein the sensor includes a tip in contact with the sensor bore.

10. The engine of claim 1, wherein the cylinder head further includes an exhaust valve disposed in the exhaust port.

11. A cylinder head comprising:

a casting defining a plurality of exhaust runners that collectively form an integrated exhaust manifold disposed within the cylinder head, wherein the casting protrudes into one of the exhaust runners to form a dimple raised from a sidewall of the one of the exhaust runners; and a sensor bore defined by the casting and extending towards the dimple such that a bottom of the sensor bore is adjacent to the dimple.

12. The cylinder head of claim 11 further comprising a temperature sensor disposed in the sensor bore and having a sensing element arranged in proximity to the dimple.

13. The cylinder head of claim 11, wherein the dimple is located on a ceiling of the exhaust runner.

14. The cylinder head of claim 11, wherein the casting further defines a plurality of exhaust ports and at least one outlet port on an exterior of the casting, and each of the exhaust runners extends from one of the exhaust ports to the at least one outlet port.

15. The cylinder head of claim 14, wherein the dimple is located nearer to the outlet port than the exhaust port.

16. The cylinder head of claim 11, wherein the casting further includes an exhaust boss, and wherein an opening of the sensor bore is disposed on the exhaust boss.

17. The cylinder head of claim 11, wherein the sensor bore includes a first section having a first diameter and a second section having a second diameter that is smaller than the first diameter.

18. The cylinder head of claim 11, wherein, the sensor bore and the dimple share a common centerline.

19. A cylinder head comprising:

a casting defining a plurality of exhaust runners that collectively form an integrated exhaust manifold disposed within the cylinder head, wherein one of the exhaust runners includes a raised dimple that forms an artificial hot spot of the casting, wherein, during operation, a temperature of the raised dimple is substantially equal to a temperature of a natural hot spot of the cylinder head; and a sensor bore defined by the casting and extending towards the dimple such that a bottom of the sensor bore is adjacent to the dimple.

20. The cylinder head of claim 19, wherein the sensor bore and the dimple share a common centerline.

* * * * *